US006070867A

United States Patent [19]

Tsurumi et al.

[11] Patent Number: 6,070,867

[45] Date of Patent: Jun. 6, 2000

[54] SHEET SUPPLYING APPARATUS

[75] Inventors: Yuzuru Tsurumi, Ushiku; Shigeru Okamura, Kawasaki; Hiroyuki Ishii, Abiko; Takeshi Niimura; Ryuichi Kojima, both of Toride; Masahide Tanoue, Kashiwa; Akira Yuza, Abiko, all of Japan

[73] Assignee: Canon Kabushiki Kaisha, Tokyo, Japan

[21] Appl. No.: 08/932,776

[22] Filed: Sep. 23, 1997

[30] Foreign Application Priority Data

Sep. 30, 1996 [JP] Japan ..... 8-278850
Jul. 18, 1997 [JP] Japan ..... 9-209894

[51] Int. Cl.[7] ..... B65H 3/06

[52] U.S. Cl. ..... 271/114; 271/116; 271/117; 271/119; 271/121; 271/126; 271/157

[58] Field of Search ..... 271/114, 116, 271/117, 118, 119, 121, 126, 157

[56] References Cited

FOREIGN PATENT DOCUMENTS 0 464 815 1/1992 European Pat. Off. .
0 567 112 10/1993 European Pat. Off. .
2-193830 7/1990 Japan .
8-225167 9/1996 Japan .

*Primary Examiner*—David H. Bollinger
*Attorney, Agent, or Firm*—Fitzpatrick, Cella, Harper & Scinto

[57] ABSTRACT

The present invention provides a drive controlling apparatus used in a sheet supplying apparatus including a lift/lower sheet supporting device for supporting a sheet, a sheet supply mechanism for feeding out the sheet supported by the sheet supporting device, a biasing mechanism for biasing the sheet supporting device toward the sheet supply mechanism, and a separating mechanism for separating the sheet supporting device from the sheet supply mechanism in opposition to a biasing force of the biasing mechanism, and wherein the sheet urged against the sheet supply mechanism by the biasing mechanism is fed out by the sheet supply mechanism, said drive controlling apparatus adapted to transmit a driving force for operating the separating mechanism from a drive source and comprising a drive side device connected to the drive source, a driven side device connected to the separating mechanism, and a play setting device for providing a play for not transmitting the driving force within a predetermined range between the drive side device and the driven side device.

21 Claims, 18 Drawing Sheets

SHEET SUPPLYING APPARATUS

BACKGROUND OF THE INVENTION

1. Field of the Invention

The present invention relates to a drive controlling apparatus, and more particularly, it relates to a drive controlling apparatus used in a sheet supplying apparatus provided in an image forming apparatus.

2. Related Background Art

Conventional image forming apparatuses such as copying machines, printers and the like each has a sheet supplying apparatus in which a drive controlling apparatus for controlling the driving of a sheet supply roller is used.

An example of a conventional drive controlling apparatus for a sheet supply roller is shown in FIG. 18. Such a drive controlling apparatus includes a sheet cassette portion, a drive portion, a sheet supply roller portion and a lock portion. Now, these portions will be briefly described.

First of all, the sheet cassette portion comprises a sheet cassette 108 and sheets 100, and the sheet cassette is provided with an intermediate plate 108 pivotable around a fulcrum 108*a*, and projections 108*c* are provided on a downstream (in a sheet supplying direction) end portion of the intermediate plate. Springs 108*d* disposed below the intermediate plate serve to bias the intermediate plate 108*b* in a direction shown by the arrow X.

Forces exerted by the springs 108*d* act on cams 121*a* of the sheet supply roller portion 121 through the projections 108*c* to tend to rotate the cams in a direction shown by the arrow Y. Thus, a sheet supply roller 109, a notched gear 121*b* and a locking member 121*c* which are secured to a rotary shaft 120 together with the cams 121*a* also tend to rotate in the direction Y. However, since a locking pawl 121*d* formed on the locking member 121*c* is engaged (locked) by a stopper 122, the sheet supply roller the sheet supply roller portion is entirely held stationary.

When the locking pawl 121*d* is disengaged from the stopper 122, the entire sheet supply portion 121 is rotated in the direction Y by a predetermined angle, with the result that a toothed portion of the notched gear 121*d* is engaged by a drive gear 127 rotated by a motor M in a direction W. Consequently, the sheet supply portion 121 is rotated by one revolution until a condition shown in FIG. 18 is restored again. After one revolution, when a non-toothed portion 121*e* of the notched gear 121*b* is opposed to the drive gear 127 again, the locking pawl 121*d* is locked by the stopper 122 again.

The engagement and disengagement between the locking member 121*c* (locking pawl 121*d*) and the stopper 122 is effected by a spring 122*c* for biasing the stopper 122 in a direction Z and a lock releasing portion for urging the stopper 122 in opposition to the force of the spring 122*c*.

That is to say, when the disengagement is effected, a locking member 123*c* of the lock releasing portion is rotated to urge the stopper 122 in opposition to the force of the spring thereby to disengage the stopper 122 from the locking pawl 121*d* of the sheet supply roller portion, thus starting the rotation of the sheet supply roller portion. Other than the above disengagement, the stopper 122 is always urged against the locking member 121*c* of the sheet supply roller portion by means of the spring 122*c*.

Now, the lock releasing portion will be described.

The lock releasing portion includes a cam 123*a*, a notched gear 123*b*, a locking member 123*c* (which are mounted on a common rotary shaft), a leaf spring 125 for applying a rotational force to the cam 123*a*, and a solenoid 126 for controlling the timing of rotation. In the condition shown in FIG. 18, although the cam 123*a* tries to rotate in a direction V by the action of the leaf spring 125, since a locking pawl 123*d* of the locking member 123*c* is locked by a solenoid actuator 126*a*, the entire lock releasing portion is held stationary.

When current is applied to the solenoid 126 to retract the solenoid actuator 126*a* toward the solenoid 126, the locking pawl 123*d* of the locking member 123*c* is disengaged from the solenoid actuator 126*a*, with the result that the cam 123*a* is rotated by the action of the leaf spring 125 by a predetermined angle. During this rotation, since a toothed portion of the notched gear 123*b* is engaged by the drive gear 127, the cam 123*a* continues to rotate by one revolution. After one revolution of the cam 123*a*, when a non-toothed portion of the notched gear 123*b* is opposed to the drive gear 127 again (FIG. 18), the locking pawl 123*d* of the locking member 123*c* is locked by the solenoid actuator 126*a* again, thereby stopping the cam.

In such a drive controlling apparatus using the notched gear, a force for rotating the notched gear until the toothed portion is engaged by the drive gear (this force is referred to as "rotation starting force" hereinafter) is required.

However, in the above-mentioned conventional drive controlling apparatus, as mentioned above, since the rotation starting force is obtained by the springs 108*d* disposed below the intermediate plate 108*b* and is transmitted directly to the notched gear 121*b* through the cams 121*a* of the sheet supply roller portion 121, the rotation starting force becomes excessive. The reason is that the springs 108*d* must provide a strong biasing force sufficient to urge the sheets 100 stacked in the cassette against the sheet supply roller 109 and this strong biasing force acts on the cams 121*a* as the rotation starting force.

However, due to such strong rotation starting force, the following problems arise. Firstly, since the strong rotation starting force increases the locking force between the locking pawl 121*d* of the sheet supply portion 121 and the stopper 122, it is impossible to release such a locking force by using a solenoid, and, thus, the above-mentioned lock releasing portion must be provided. As a result, the entire apparatus becomes complicated.

Secondary, due to the strong rotation starting force, after the lock is released, when the notched gear 121*b* is engaged by the drive gear 127, the excessive force acts on the drive gear, with the result that the rotational speed of the drive gear is increased by an amount corresponding to backlash between a gear of the motor M and the drive gear (refer to FIG. 19).

Other than the above-mentioned arrangement in which the rotation starting force is obtained by the springs disposed below the intermediate plate, even when an arrangement in which a rotation starting force is obtained from an independent spring is used as disclosed in Japanese Patent Application Laid-open No. 2-193830, a biasing force of such a spring acts as a rotational force for rotating a sheet supply roller via a cam, and, when a notched gear is engaged by a drive gear after the lock is released, the excessive force also acts on the drive gear.

The increase in the rotational speed of the drive gear affects an influence upon all of gears associated with the drive gear. For example, as is in a normal case, when the drive gear is associated with a convey roller gear for directly conveying a sheet to a transfer portion, a rotational speed of the convey roller is also increased to push the sheet into the transfer portion excessively, thereby causing deviation of an image and worsening image quality. Further, the convey speed of the entire convey portion is unbalanced, thereby causing sheet jam.

The above problems may be caused in general drive controlling apparatuses. Thus, there is a need for providing a drive controlling apparatus for transmitting rotation from a drive source to a rotary shaft, in which the initiation of rotation of the rotary shaft does not affect an influence upon the drive source.

SUMMARY OF THE INVENTION

The present invention aims to solve the above-mentioned conventional problems by providing an adequate rotation starting force by a mechanism other than springs disposed below an intermediate plate and cams of a sheet supply portion, and an object of the present invention is to provide a drive controlling apparatus in which a construction of a lock releasing mechanism is simple and the number of parts is reduced and productivity and drive controlling accuracy are excellent. Another object of the present invention is to provide a sheet supplying apparatus in which productivity is improved and a sheet supply roller is stabilized by utilizing such a drive controlling apparatus. A further object of the present invention is to provide an image forming apparatus in which productivity is improved and sheet supplying accuracy and image forming accuracy are also improved.

DETAILED DESCRIPTION OF THE PREFERRED EMBODIMENTS

Figure 1A:
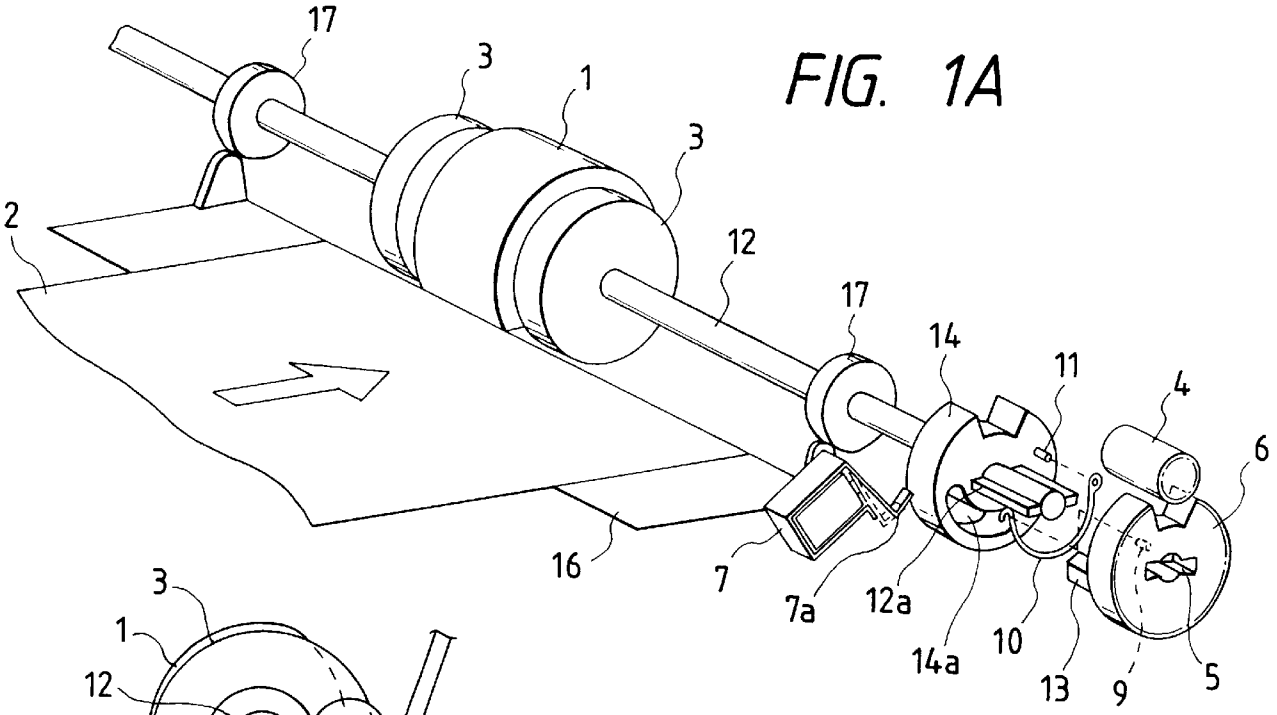
FIG. 1A is an exploded perspective view of a sheet supplying apparatus according to a preferred embodiment of the present invention.

The present invention will now be explained in connection with embodiments thereof with reference to the accompanying drawings. However, dimensions, materials, configurations and relative dispositions of constructural elements in the embodiments do not limit the scope of the present invention, except for special limitations.

FIGS. 1A, 1B, 2A and 2B schematically show a sheet supplying apparatus using a drive controlling apparatus according to a preferred embodiment of the present invention. FIGS. 3A to 3D show an operation of the sheet supplying apparatus.

First of all, the construction of the sheet supplying apparatus will be described with reference to FIGS. 1A and 1B.

The sheet supplying apparatus comprises a semi-circular sheet supply roller 1 secured to a rotary shaft 12, and rollers 3 rotatably mounted on the rotary shaft 12 on both sides of the sheet supply roller 1. An intermediate plate 16 is supported for pivotal movement around an upstream (in a supplying direction of a sheet 2 shown by the arrow in FIG. 1A) end thereof and is biased toward the sheet supply roller 1 by means of coil springs 16*b*.

Cams 17 are secured to the rotary shaft 12 and projections 16*a* are secured to the intermediate plate 16 so that the cams are contacted with the projections. As the rotary shaft 12 is rotated, the cams 17 urges the projections 16*a* downwardly, thereby separating the sheet supply roller 1 and the rollers 3 from the sheet stack 2 rested on the intermediate plate 16 in a condition that a cut-out portion or flat portion of the sheet supply roller 1 is opposed to the sheet stack 2. In this way, the operability for removing the sheets from the intermediate plate 16 and for replenishing the sheet onto the intermediate plate can be improved.

Figure 1B:
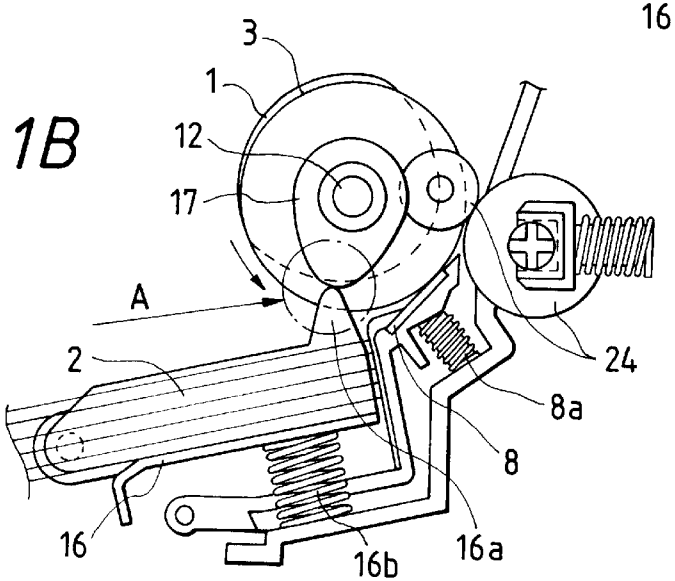
FIG. 1B is a schematic sectional view of the sheet supplying apparatus.

In FIG. 1B, a separation pad 8 is biased toward the sheet supply roller 1 by a coil spring 8*a* to separate the sheets (on the intermediate plate 16) fed to the sheet supply roller 1 one by one. The sheet separated by the separation pad 8 is conveyed toward an image forming means by means of a pair of convey rollers 24.

With this arrangement, in the sheet supply, if the intermediate plate 16 is in the elevated position, the sheet to be supplied is pinched not only between the separation pad 8 and the rollers 3 but also between the sheet stack 2 rested on the intermediate plate 16 and the rollers 3, with the result that a load acting on the sheet becomes great, thereby increasing the load of a drive system. To avoid this, when the sheet reaches the downstream convey rollers, the intermediate plate 16 is lowered by the cams 17 to decrease the load acting on the sheet.

The rollers 3 disposed on both sides of the sheet supply roller 1 have diameters slightly smaller than a diameter of a cylindrical portion of the sheet supply roller 1 so that, when the flat portion of the sheet supply roller 1 is opposed to the separation pad 8, the rollers 3 urge the sheet against the separation pad 8, thereby stabilizing the separation of the sheet on the separation pad 8. In the arrangement as mentioned above, since the rollers can be rotated in a reverse direction, if the sheet is jammed between the sheet supply roller 1 and the separation pad 8, the jammed sheet can easily be removed, thereby facilitating the jam treatment.

Figure 2A:
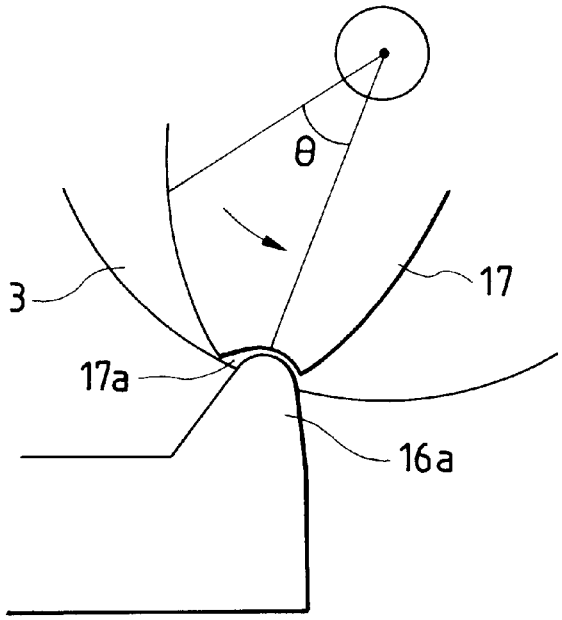
FIG. 2A is an enlarged view showing a portion indicated by the arrow A in FIG. 1B.

As shown in FIG. 2A, each cam 17 is provided with a recess 17*a*. When the recesses 17*a* of the cams 17 are engaged by the projections 16*a* of the intermediate plate 16, the rotary shaft 12 and the sheet supply roller 1 are held stationary.

Next, a drive controlling apparatus for the sheet supply roller which is one of characteristics of the present invention will be explained.

In FIG. 1A, a drive controlling apparatus for controlling the transmission of a driving force to the sheet supply roller 1 is provided on one end of the rotary shaft 12. The drive controlling apparatus includes a drive gear 4 connected to a drive source such as a motor (not shown), and first and second notched gears 14, 6 which can be engaged by the drive gear 4.

The first notched gear 14 is attached to the rotary shaft 12 so that, when the recesses 17*a* of the cams 17 are engaged by the projections 16*a* of the intermediate plate 16, a non-toothed portion of the first notched gear is opposed to the drive gear 4. Thus, the recesses 17*a* and the projections 16*a* act as a first regulating means for regulating the first notched gear 14. Incidentally, recesses may be provided in the projections of the intermediate plate 16 and projections may be provided on the cams 17.

The second notched gear 6 has a key-way 5 loosely fitted on a key portion 12*a* of the rotary shaft 12 so that the second notched gear can be rotated within a predetermined range. Further, the second notched gear 14 is provided with a pawl portion 13 which extends through a slot 14*a* formed in the first notched gear 14 and is engaged or locked by a solenoid 7 disposed at an opposite side (near the sheet supply roller 1) of the first notched gear 14 with respect to the second notched gear 6. In this case, the second notched gear 6 and the solenoid 7 are so arranged that the second notched gear 6 is held stationary by the solenoid in a condition that a non-toothed portion of the second notched gear 6 is opposed to the drive gear 4. Thus, the pawl portion 13 and the solenoid 7 act as a second regulating means for regulating the second notched gear 6.

The reason why the solenoid 7 is disposed nearer to the sheet supply roller 1 than the first notched gear 14 is that the entire apparatus is prevented from becoming bulky in a width-wise direction of the sheet due to the installation space of the solenoid 7. Thus, so long as the entire apparatus does not become bulky, the solenoid can be disposed at any position.

A spring 10 serves as a rotating means and has one end secured to a fixed portion 11 of the first notched gear 14 and the other end secured to a fixed portion 9 of the second notched gear 6. An elastic force is generated in the spring in dependence upon a relative position between the first and second notched gears 14 and 6. Since the first notched gear 14 and the sheet supply roller 1 are secured to the rotary shaft 12, the sheet supply roller 1 is rotated together with the first notched gear 14.

Next, an operation of the drive controlling apparatus will be explained with reference to FIGS. 3A to 3D.

Figure 3A:
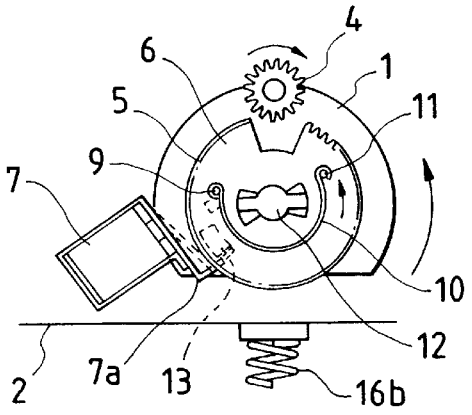
FIGS. 3A, 3B, 3C and 3D are sectional views for explaining an operation of the sheet supplying apparatus.

FIG. 3A shows an initial condition. In this condition, the non-toothed portion of the first notched gear 14 is aligned with the non-toothed portion of the second notched gear 6 in the axial direction, and these gears 14, 6 are not engaged by the drive gear 4.

In this condition, the spring (biasing means) 10 generates a given elastic force in the compression direction, but the first and second notched gears 14, 6 are held stationary in opposition to the elastic force.

The reason why the first notched gear 14 is held stationary is that, as shown in FIG. 1A, the first notched gears 14 is fixed to the cams 17 via the rotary shaft 12 and the recesses 17*a* (first regulating means) of the cams 17 are engaged by the projections 16*a* of the intermediate plate 16 to provide the stable condition, as shown in FIG. 2A. On the other hand, the reason why the second notched gear 6 is held stationary is that the locking pawl (locking portion) 13 of the second notched gear is locked (engaged) by a locking pawl 7*a* of the solenoid (second regulating means) 7 which is now disenergized.

Figure 3B:
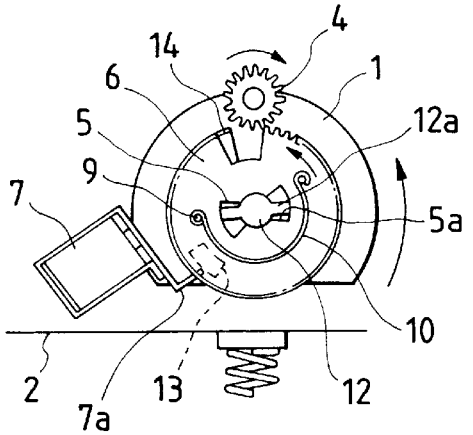
Figure 3C:
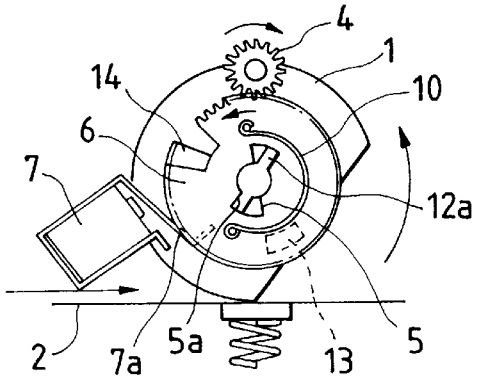
Figure 3D:
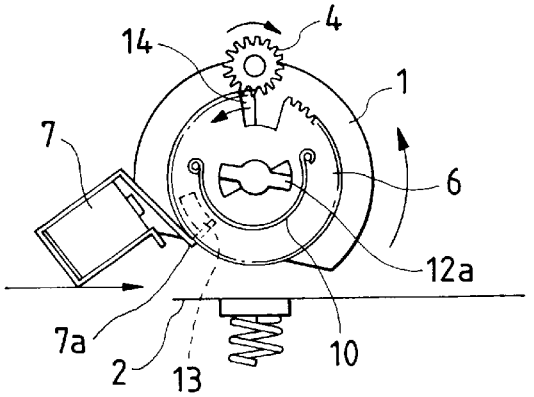
Figure 4A:
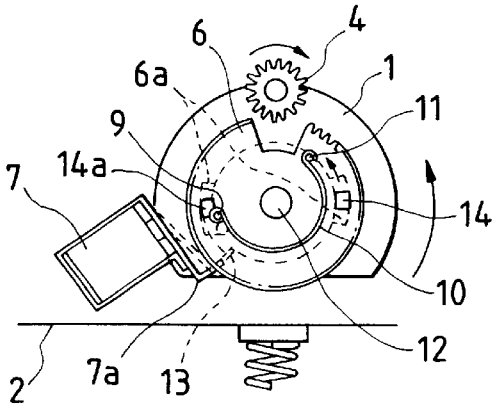
FIGS. 4A, 4B, 4C and 4D are sectional views for explaining an operation of a sheet supplying apparatus according to another embodiment of the present invention.
Figure 4B:
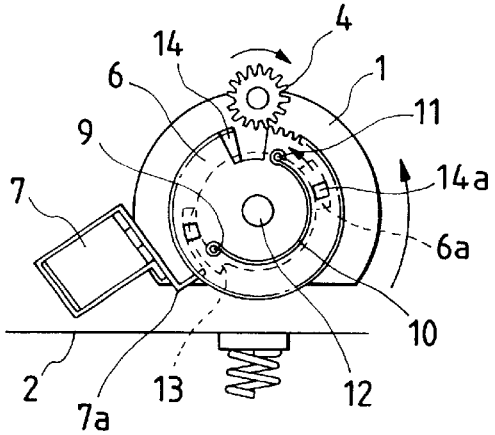
Figure 4C:
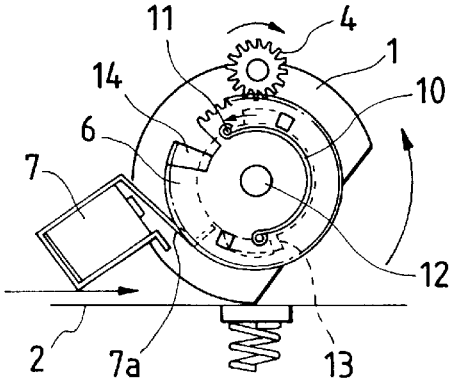
Figure 4D:
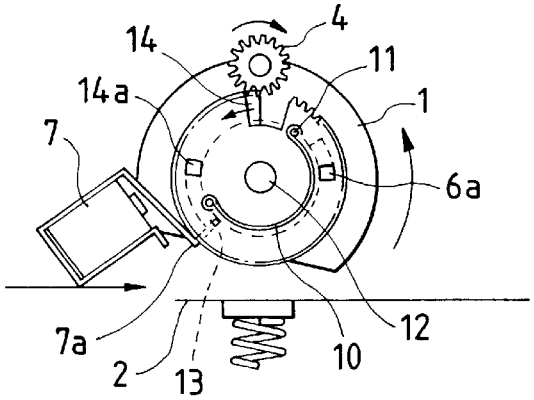
Figure 5A:
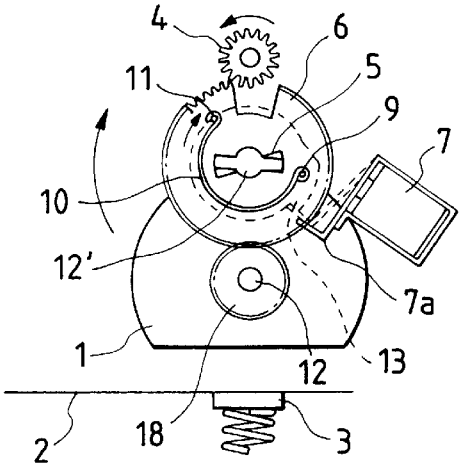
FIGS. 5A, 5B, 5C and 5D are sectional views for explaining an operation of a sheet supplying apparatus according to a further embodiment of the present invention.
Figure 5B:
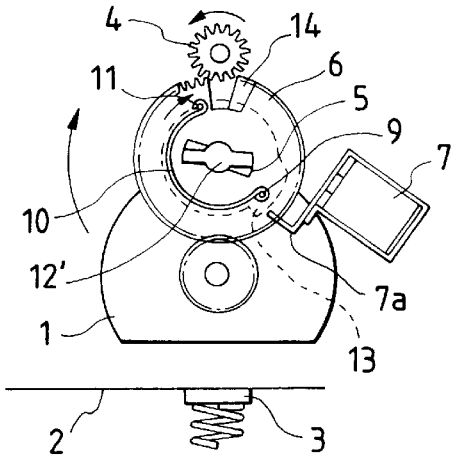
Figure 5C:
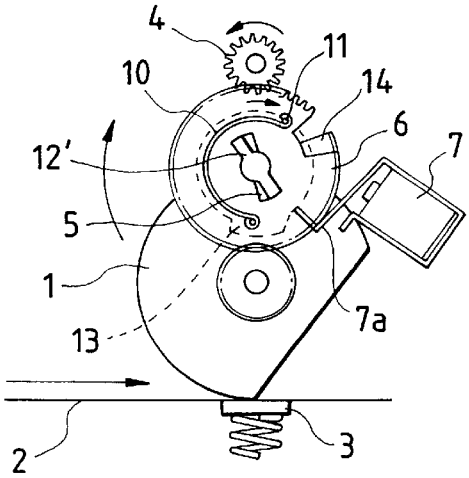
Figure 5D:
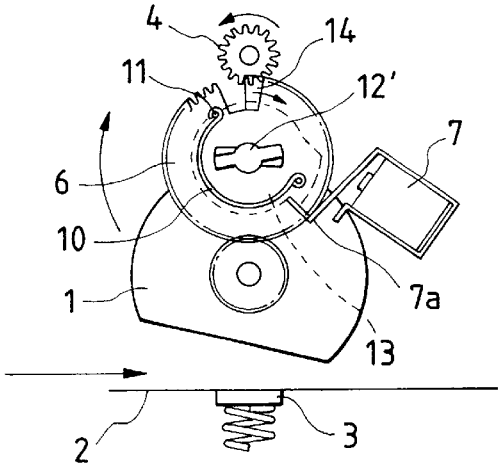

From the condition shown in FIG. 3A, when the solenoid 7 is energized to release the locking condition, a condition shown in FIG. 3B in which only the second notched gear 6 is engaged by the drive gear 4 is obtained.

That is to say, when the locking pawl 13 is released from the locking pawl 7*a* of the solenoid 7, only the second notched gear 6 is rotated in the anti-clockwise direction by the elastic force of the spring 10. Namely, since the first notched gear 14 is fixed to the sheet supply roller 1 via the rotary shaft 12 and thus has the greater resistance than the second notched gear 6 and the first notched gear 14 is held stationary due to the engagement between the recesses 17*a* and the projections 16*a*, only the second notched gear 6 is rotated by the elastic force of the spring 10 to be engaged by the drive gear 4.

In this case, since there is the play between the key-way 5 of the second notched gear 6 and the key portion 12*a* of the rotary shaft 12 to permit the normal and reverse rotations of the key-way 5 relative to the key portion 12*a*, when the second notched gear 6 starts to be engaged by the drive gear 4, even if the teeth of these gears 6, 4 interfere with each other, the second notched gear 6 is slightly rotated in the normal or reverse direction to prevent clogging of the teeth, thereby smoothly engaging the second notched gear with the drive gear.

When the second notched gear 6 is further rotated to reach a first rotation limit position (where the rotation of the second notched gear 6 relative to the first notched gear 14 is inhibited), a side wall 5*a* of the key-way 5 abuts against the key portion 12*a* to rotate the first notched gear 14 (together with the second notched gear 6) until the first notched gear is engaged by the drive gear 4. In this case, the side wall 5*a* of the key-way 5 is so configured that, when the side wall 5*a* abuts against the key portion 12*a*, angular phases of teeth of the first and second notched gears 14, 6 are aligned with each other, with the result that, when the first notched gear 14 is engaged by the drive gear 4, there is no interference between the teeth of the gears 14 and 4.

With the arrangement as mentioned above, as is in the conventional case, from when the first notched gear 14 starts to rotate to when the first notched gear 14 is engaged by the drive gear 4, the biasing force of the springs 16*b* acting on the intermediate plate 16 may act on the cams 17 via the projections 16*a* as a rotational force for rotating the first notched gear 14.

However, this rotational force causes the rotary shaft 12 to rotate faster than the second notched gear 6. Even when the key portion 12*a* is separated from the side wall 5*a* of the key-way 5, since there is the clearance, the rotational speed of the second notched gear 6 is not increased. Further, since the rotational force is ceased before the first notched gear 14 is engaged by the drive gear 4, the key portion 12*a* abuts against the side wall 5*a* of the key-way 5 again, thereby continuing the rotation.

More specifically, the biasing force from the intermediate plate 16 acts on the cams 17 as the rotational force only while the rotary shaft is rotated through an angle of about θ shown in FIG. 2A. Here, since an angle through which the rotary shaft must be rotated to engage the first notched gear 14 with the drive gear 4 is selected to be greater than the angle θ, the rotational force is not transmitted to the drive gear 4 through the first notched gear 14.

Thus, the first notched gear 14 and accordingly the sheet supply roller 1 can start to rotate without affecting any force to the drive gear 4 and without arising any problem due to the backlash.

After the first notched gear 14 is smoothly engaged by the drive gear 4 in this way, the first notched gear 14 continues to be rotated by the drive gear 4. In a condition that both first and second notched gears 14 and 6 are engaged by the drive gear 4 (i.e., condition shown in FIG. 3C in which the sheet supply roller 1 starts to pick up and convey the sheet), when the gears are further rotated, after the second notched gear 6 is rotated by one revolution, it is disengaged from the drive gear 4 (condition shown in FIG. 3D).

However, in this condition, the first notched gear 14 is still engaged by the drive gear 4. When the first notched gear 14 tries to further rotate, the spring 10 disposed between the first notched gear 14 and the second notched gear 6 generates the elastic force again, with the result that the second notched gear 6 is further rotated by the elastic force. Thereafter, when the locking pawl 13 is caught by the locking pawl 7*a* of the solenoid 7, the gear is stopped and the condition shown in FIG. 3A is restored.

Figure 2B:
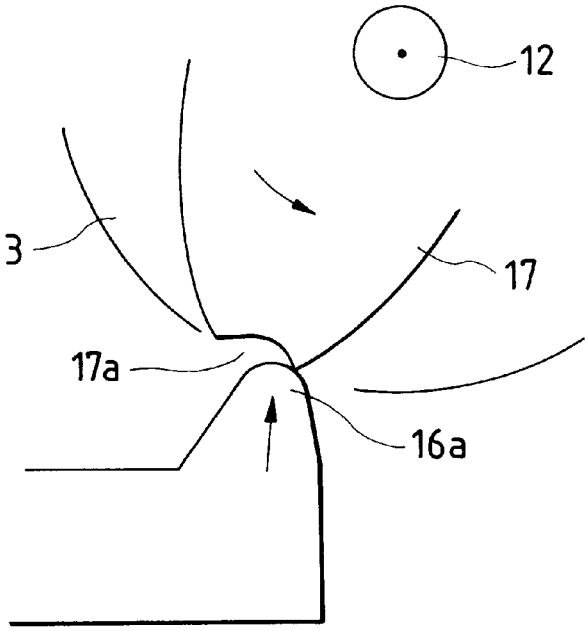
FIG. 2B is a view showing a condition immediately before a condition of FIG. 2A is reached.

On the other hand, immediately after the first notched gear 14 is disengaged from the drive gear 4, as shown in FIG. 2B, a condition that the recesses 17*a* of the cams 17 are about to be engaged by the projections 16*a* of the intermediate plate 16. In this condition, since the intermediate plate 16 is biased toward the sheet supply roller 1 by the springs 16*b*, the cams 17 are rotated in the direction for engaging the recesses 17*a* with the projections 16*a*, and, at the same time, the first notched gear 14 is also rotated to return to the condition shown in FIG. 3A. That is to say, the force of the projections 16*a* acting on the recesses 17*a* immediately before the recesses 17*a* are engaged by the projections 16*a* is set so at to act as the rotational force for rotating the cams 17 in the direction for engaging the recesses 17*a* with the projections 16*a*.

As mentioned above, in the sheet supplying apparatus according to the illustrated embodiment, the sheet supply roller 1 can be driven smoothly and efficiently with a simple construction and the jam treatment and the replenishment of sheets can be performed easily.

In the above-mentioned embodiment, while an example that the key portion 12*a* provided on the rotary shaft 12 and the key-way 5 formed in the second notched gear 6 constitute the cooperating means was explained, in a sheet supplying apparatus shown in FIGS. 4A to 4D, a cooperating means is constituted by key portions 14*a* provided on a first notched gear 14 and key-ways 6*a* formed in a second notched gear 6, and, the key portions 14*a* and key-ways 6*a* are not positioned on the rotary shaft 12 but are spaced apart from the rotary shaft.

In this arrangement, in comparison with the key portion formed on the rotary shaft, since the load acting on the key portions during the rotation is reduced because of separation of the key portions from the rotary shaft, the key portions themselves can be made small-sized.

In the above-mentioned embodiments, while an example that the first notched gear 14 is directly secured to the rotary shaft 12 was explained, in a sheet supplying apparatus shown in FIGS. 5A to 5D, a gear 18 is secured to the rotary shaft 12 and the first notched gear 14 is meshed with the gear 18. In this way, the rotation of the drive controlling apparatus is transmitted to the sheet supply roller 1 to supply the sheet.

By arranging the gear 18 between the first notched gear 14 and the rotary shaft 12 in this way, the degree of freedom of layout is increased.

Figure 6:
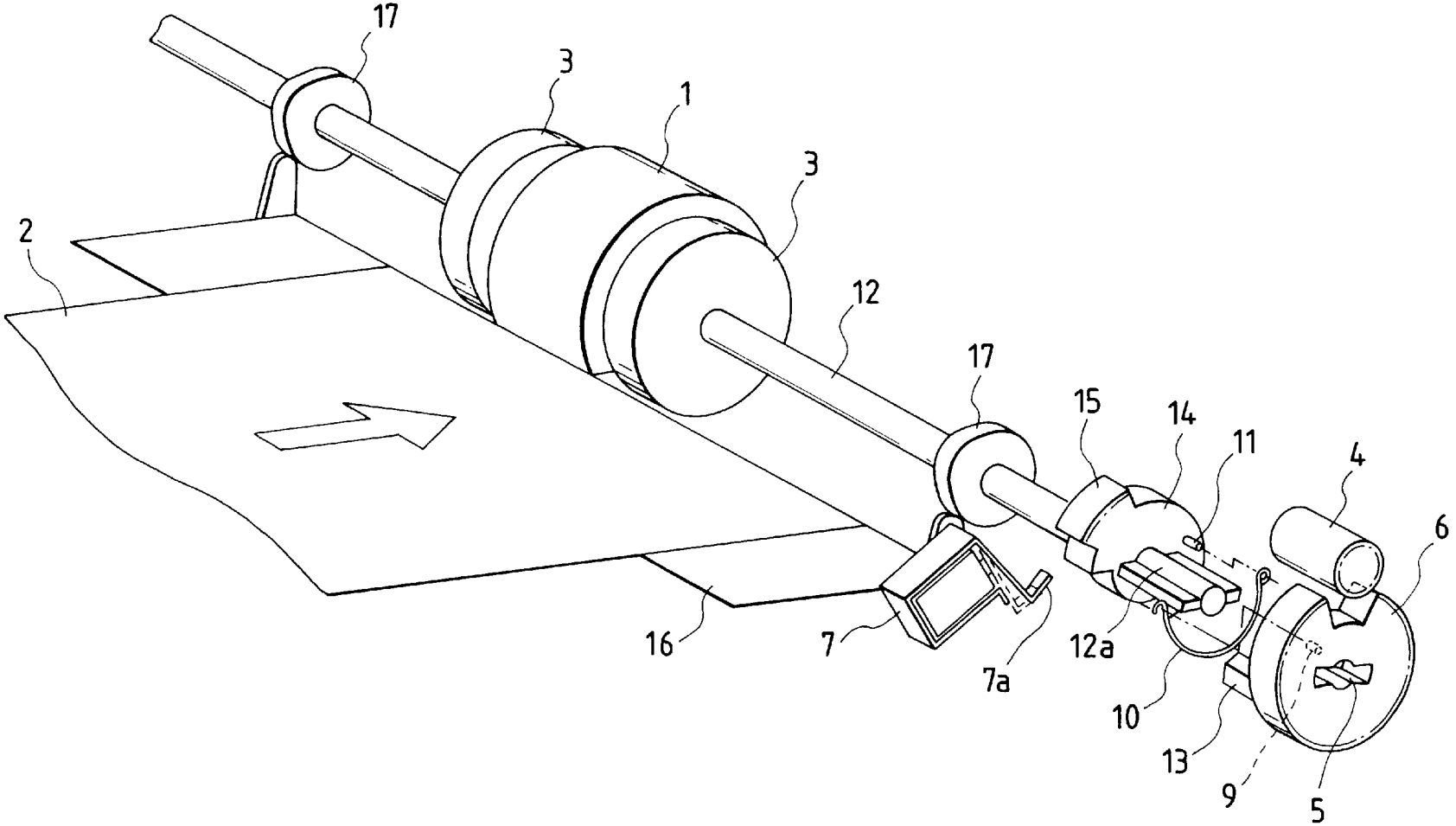
FIG. 6 is an exploded perspective view of a sheet supplying apparatus according to a still further embodiment of the present invention.

In the above-mentioned embodiments, while an example that the first and second notched gears 14, 6 have the similar non-toothed portions was explained, in a sheet supplying apparatus shown in FIG. 6, a first notched gear 14 has a toothed portion 15 provided thereon only at a rear portion thereof in a rotational direction, as shown in FIG. 6. That is to say, while the second notched gear 6 receiving the rotation starting force from the spring 10 is being rotated while engaging with the drive gear 4, since the side wall 5*a* of the key-way 5 abuts against the key portion 12*a* of the rotary shaft 12 to impart the rotational force to the sheet supply roller 1, there is no need for providing a toothed portion on the first notched gear 14 at that portion, and, thus, any toothed portion is omitted at that portion.

However, when the second notched gear 6 is disengaged from the drive gear 4 and is stopped by the second regulating means, since the rotational force of the first notched gear 14 is disappeared, the toothed portion is provided on a portion of the first notched gear 14 so that the first notched gear 14 is positively rotated until the non-toothed portions of the first and second notched gears are opposed to the drive gear 4.

Figure 7:
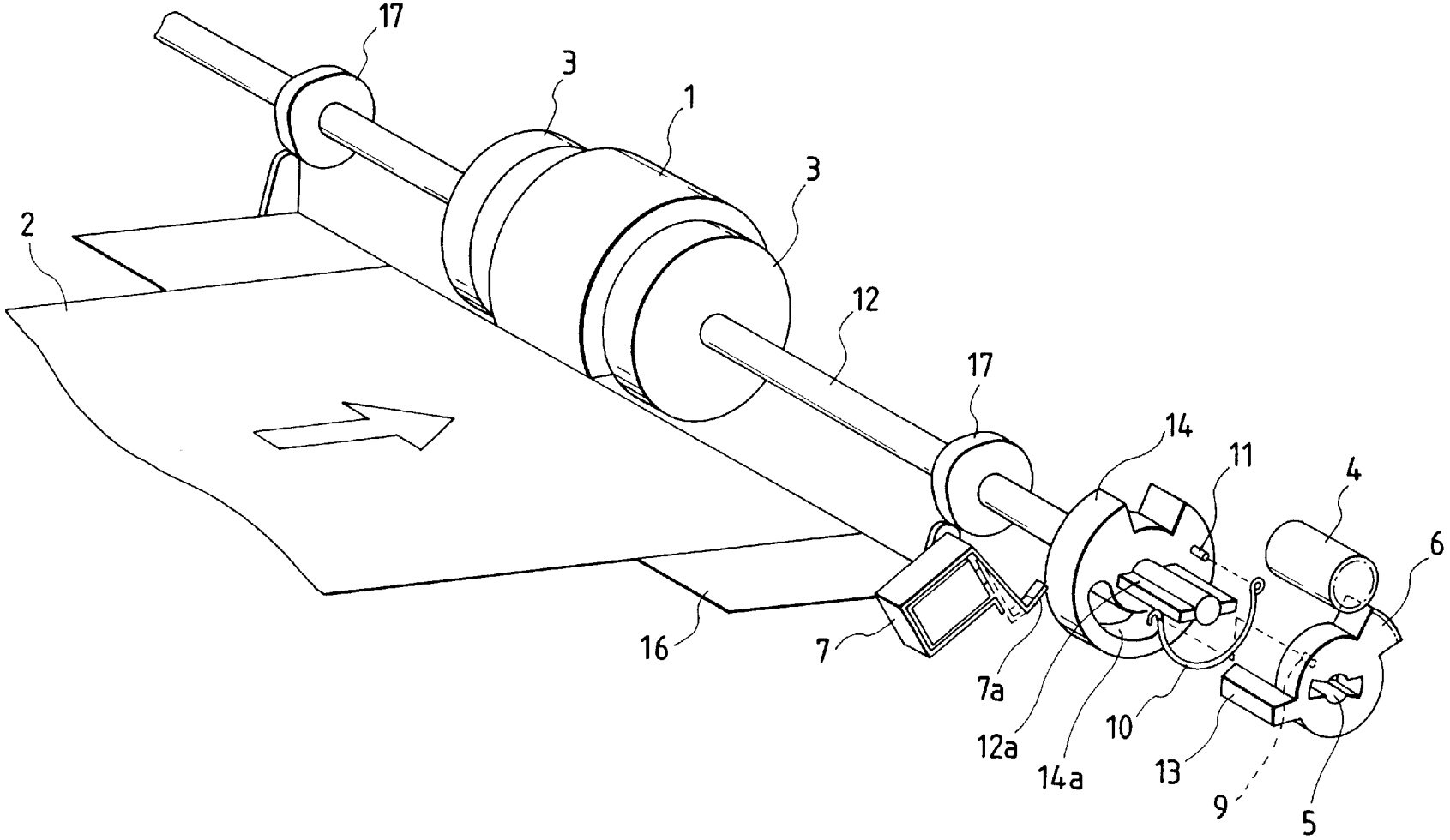
FIG. 7 is an exploded perspective view of a sheet supplying apparatus according to a further embodiment of the present invention.
Figure 8:
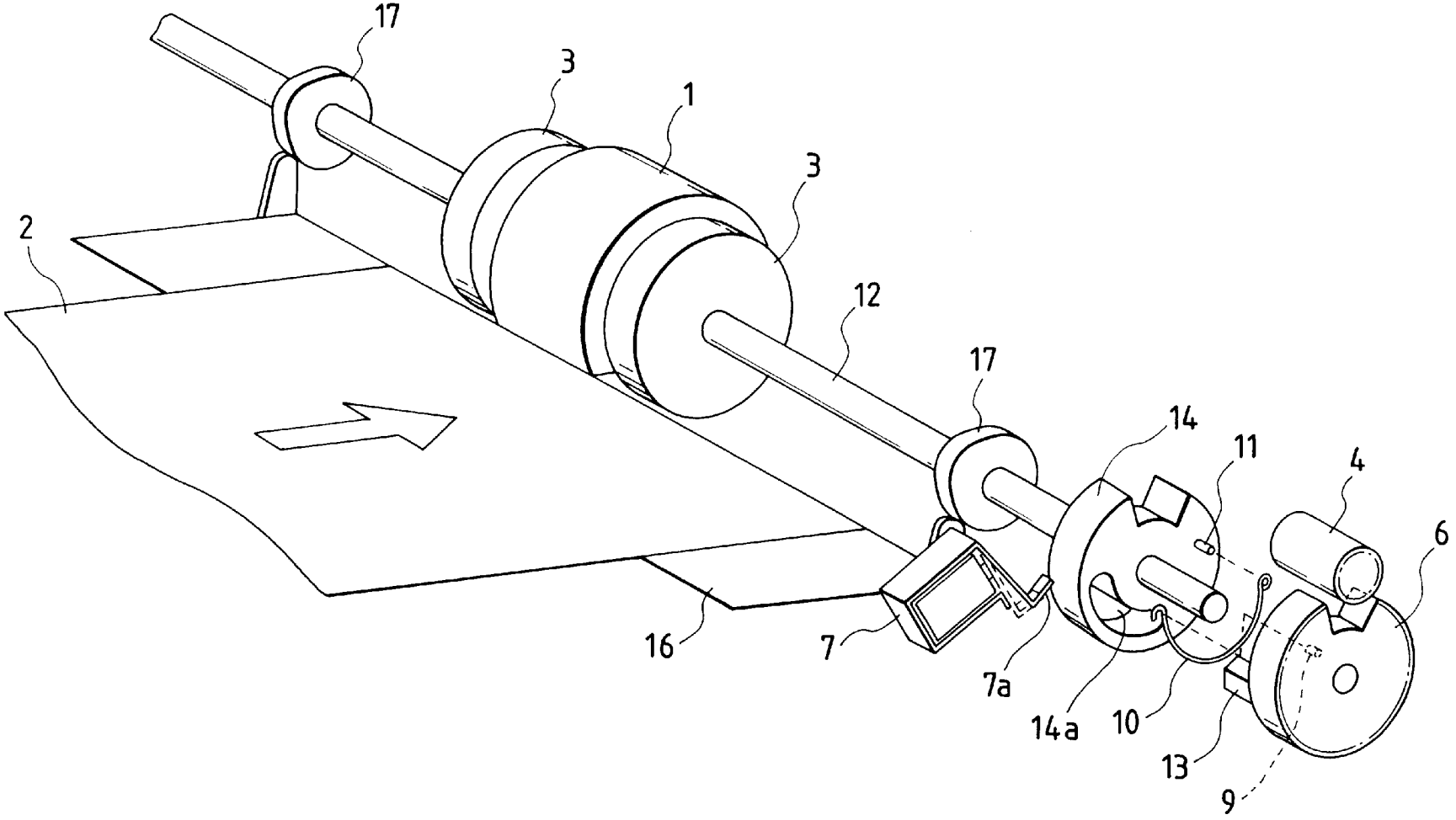
FIG. 8 is an exploded perspective view of a sheet supplying apparatus according to a still further embodiment of the present invention.

Alternatively, in a sheet supplying apparatus shown in FIG. 7, a second notched gear 6 has a toothed portion provided thereon only at a front portion thereof in a rotational direction, as shown in FIG. 7. That is to say, while the second notched gear 6 receiving the rotation starting force from the spring 10 is being rotated while engaging with the drive gear 4, the side wall 5*a* of the key-way 5 abuts against the key portion 12*a* of the rotary shaft 12 to start the rotation of the first notched gear 14. The second notched gear 6 plays an role for rotating the first notched gear 14 until the first notched gear is engaged by the drive gear 4.

Thereafter, since the first notched gear 14 receives the rotational force directly from the drive gear 4, it is not required that the second notched gear 6 receives the rotational force from the drive gear 4. Thus, any toothed portion is omitted from the second notched gear at that portion.

In the above-mentioned embodiments, while an example that the spring 10 is used as the rotating means and the key-way 5 and the key portion 12*a* are used as the cooperating means was explained, in a sheet supplying apparatus shown in FIGS. 8 and 9A to 9D, spring 10 is used as both rotating means and cooperating means.

An operation of a drive controlling apparatus associated with this sheet supplying apparatus will be explained with reference to FIGS. 9A to 9D. In an initial condition shown in FIG. 9A, the first and second notched gears 14, 6 are not engaged by the drive gear 4. From this condition, when the solenoid 7 is energized, a condition (FIG. 9B) that the second notched gear 6 is engaged by the drive gear 4 is obtained.

However, thereafter, when the second notched gear 6 starts to rotate while engaging with the drive gear 4, a force tending to compress the spring 10 is transmitted as a rotation force for rotating the first notched gear 14 in an anti-clockwise direction relative to the second notched gear 6, thereby starting rotation of the first notched gear 14.

In this case, spring constant of the spring 10 and dimension of the non-toothed portion of the first notched gear 14 are selected so that the first notched gear 14 is engaged by the drive gear 4 after the rotational force transmitted from the cams 17 is absorbed by the spring 10.

Figure 9A:
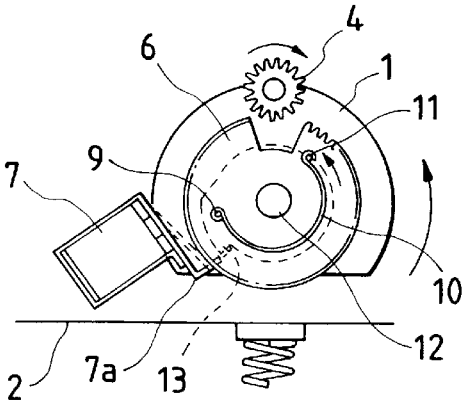
FIGS. 9A, 9B, 9C and 9D are sectional views for explaining an operation of the sheet supplying apparatus of FIG. 8.
Figure 9B:
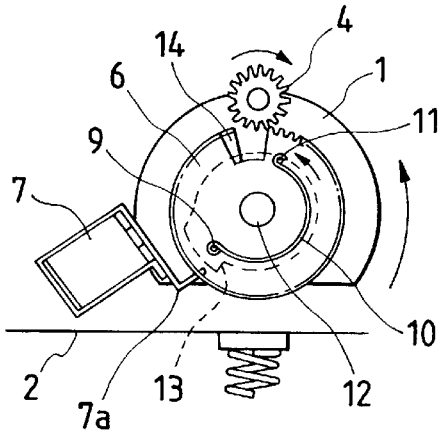
Figure 9C:
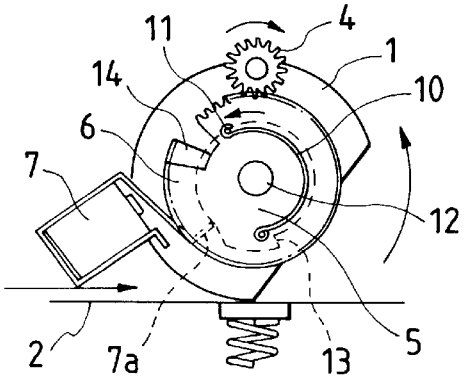
Figure 9D:
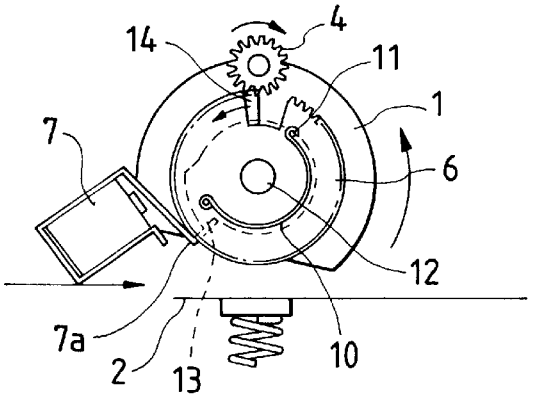

After a condition shown in FIG. 9C is obtained, when the gears are further rotated to disengage the second notched gear 6 from the drive gear 4 again, the pawl 13 of the second notched gear is caught by the locking pawl 7*a* of the solenoid 7, thereby stopping the second notched gear 6 (condition shown in FIG. 9D).

Figure 10:
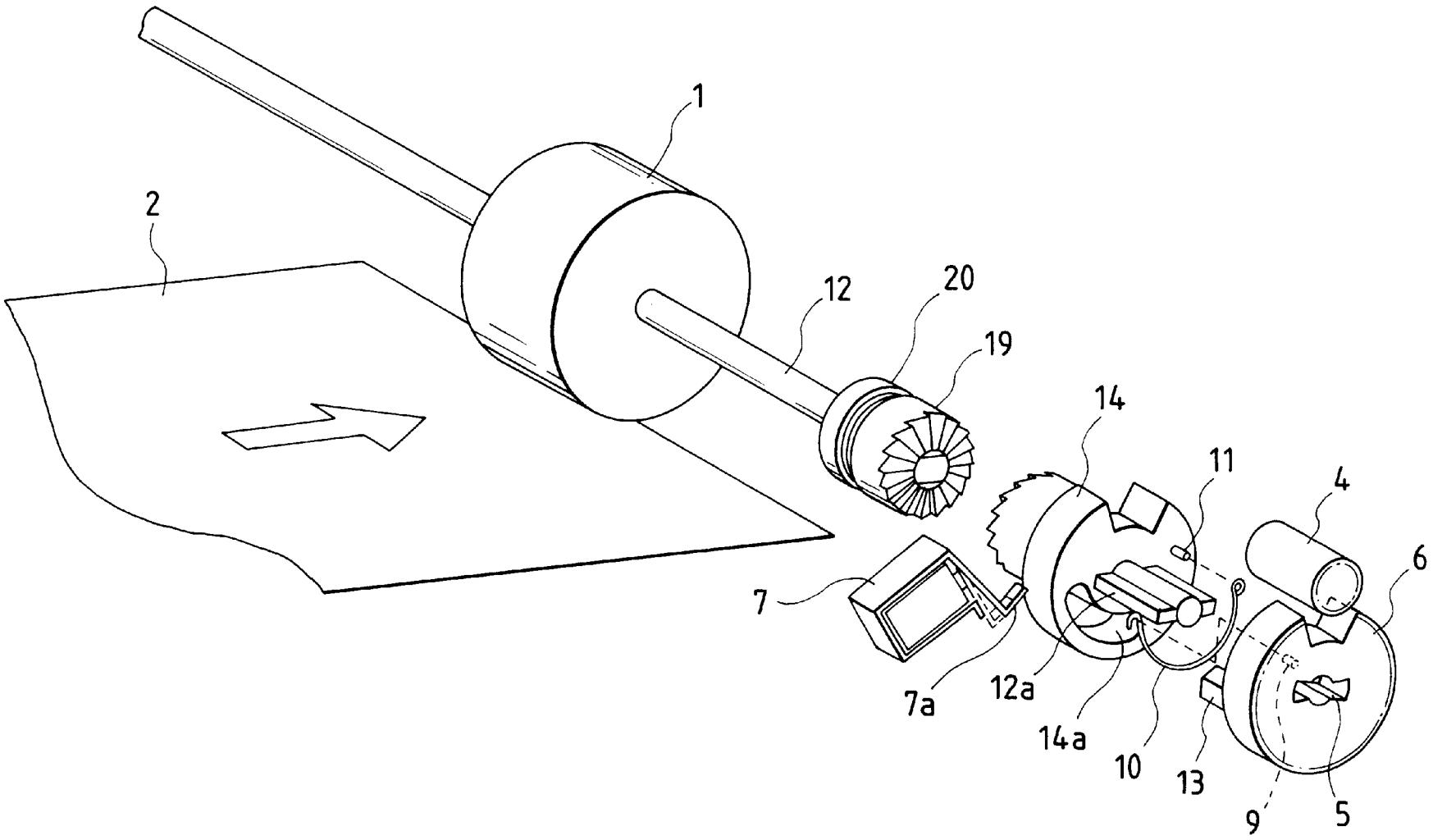
FIG. 10 is an exploded perspective view of a sheet supplying apparatus according to a further embodiment of the present invention.

In the above-mentioned embodiments, while an example that the semi-circular roller is used as the sheet supply roller 1 was explained, in a sheet supplying apparatus shown in FIG. 10, a cylindrical sheet supply roller 1 is used and cams are omitted. Thus, an intermediate plate is always urged against the sheet supply roller.

With this arrangement, until the sheet 2 is sullied completely, i.e., until a trail end of the sheet 2 leaves the sheet supply roller 1, the sheet is always pinched between the roller 1 and the separation pad 8 (FIG. 1B). In this arrangement, in a condition that the locking of the solenoid 7 is released, since the sheet supply roller 1 cannot be rotated in the sheet supplying direction except that the roller is rotated together with the first and second notched gears 14, 6, it is difficult to supply the sheet for a predetermined amount.

To cope with this, a one-way clutch 19 is provided between the first notched gear 14 and the rotary shaft 12 so that the sheet supply roller alone can be rotated in the sheet supplying direction (even when the first notched gear is stopped).

In this embodiment, a half clutch portion of the one-way clutch 19 is integrally formed with the first notched gear 14 and the other half clutch portion is mounted on an end portion of the rotary shaft 12. A one-way clutch spring 20 is associated with the half clutch portion of the rotary shaft 12 so that said half clutch portion is biased toward the first notched gear. In this way, the rotational force from the first notched gear 14 can be transmitted to the rotary shaft 12 and the rotational force from the rotary shaft 12 can be transmitted to the first notched gear 14.

Alternatively, a one-way clutch including a gear may provided for cooperating with the second notched gear so that the gear can be engaged by the second notched gear to transmit the rotational force.

When the cylindrical sheet supply roller is used in this way, since the cams and rollers can be omitted, the entire apparatus can be simplified.

Figure 11:
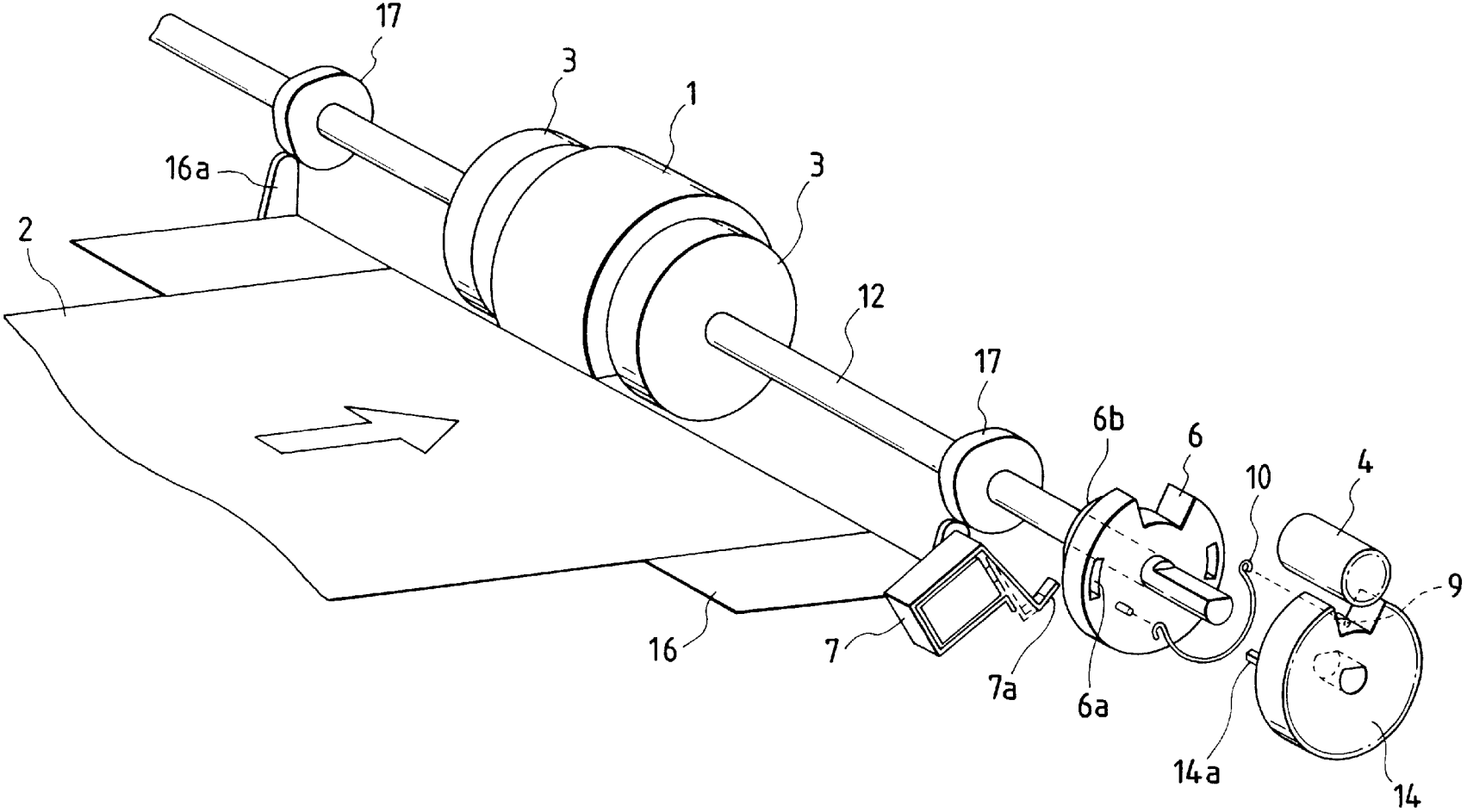
FIG. 11 is an exploded perspective view of a sheet supplying apparatus according to a still further embodiment of the present invention.

In a sheet supplying apparatus shown in FIG. 11, the first and second notched gears 14 and 6 in the aforementioned embodiment are disposed reversely in the axial direction of the rotary shaft. That is to say, a second notched gear 6 is rotatably supported on the rotary shaft 12 between the sheet supply roller 1 and a first notched gear 14, and key portions 14*a* of the first notched gear 14 and key-ways 6*a* of the second notched gear 6 are spaced apart from the rotary shaft 12 to increase the degree of freedom around the shaft.

Further, a semi-circular portion is formed at the end of the rotary shaft 12 and a similar semi-circular hole is formed in the first notched gear 14. By fitting the semi-circular hole onto the semi-circular portion, the first notched gear cannot slip on the rotary shaft during the rotation.

In this arrangement in which the second notched gear 6 is disposed between the sheet supply roller 1 and the first notched gear, unlike to the aforementioned embodiments, since it is not required to provide any hole (in the first notched gear) through which the locking pawl 13 associated with the locking pawl 7*a* of the solenoid 7 protrudes toward the solenoid 7, the construction can be simplified. Further, in this embodiment, in place of such a pawl 13, a locking portion 6*b* cooperating with the locking pawl 7*a* is formed on a surface of the second notched gear 6 near the sheet supply roller 1. The locking portion 6*b* and the solenoid 7 constitute a second regulating means.

Figure 12:
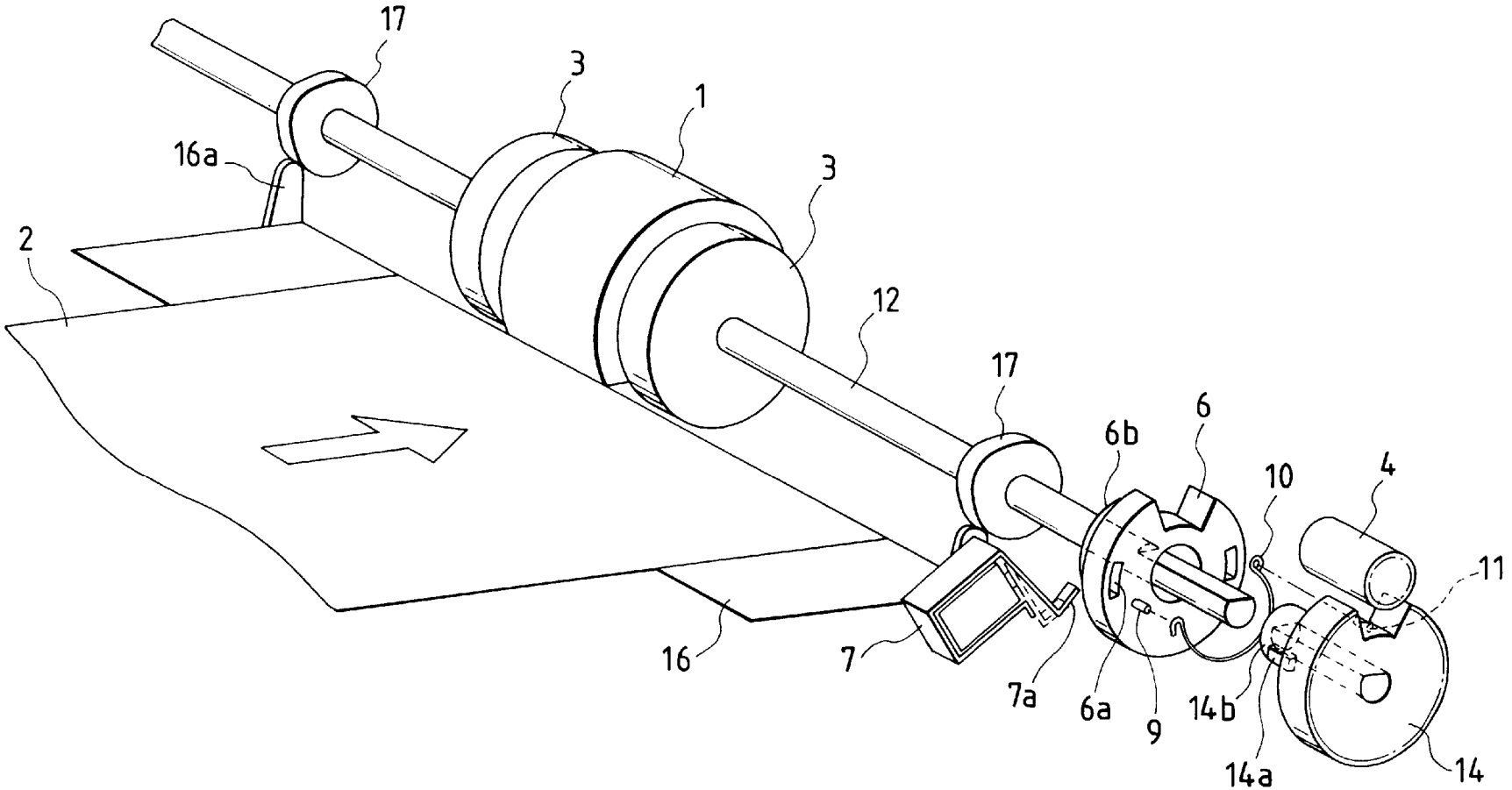
FIG. 12 is an exploded perspective view of a sheet supplying apparatus according to a further embodiment of the present invention.
Figure 13:
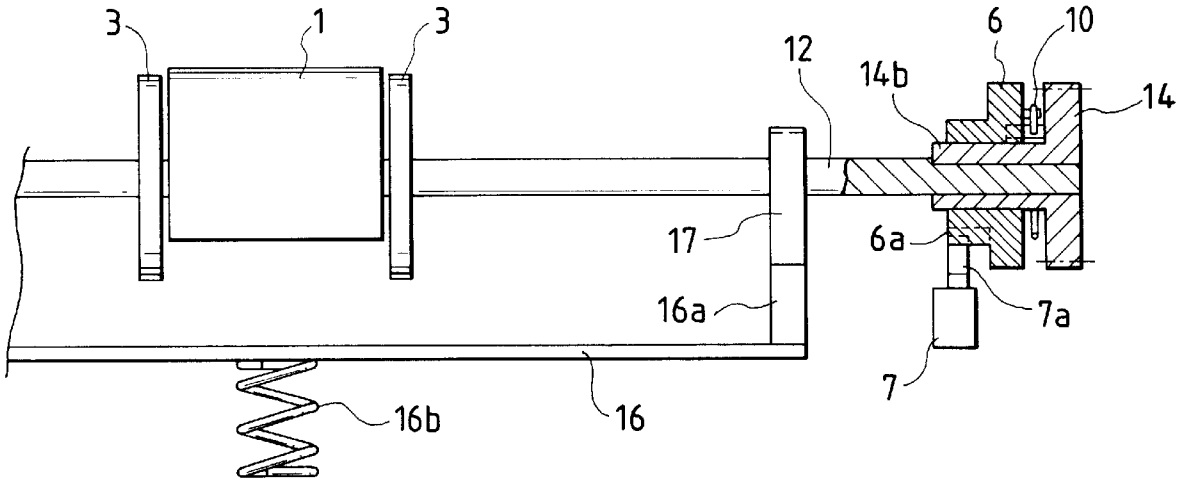
FIG. 13 is a side view, in partial section, of the sheet supplying apparatus of FIG. 12.

A sheet supplying apparatus shown in FIGS. 12 and 13 is similar to that shown in FIG. 11. However, in the sheet supplying apparatus shown in FIGS. 12 and 13, a shaft portion 14*b* into which the semi-circular portion of the rotary shaft 12 is fitted is provided on the first notched gear 14, and the second notched gear 6 is rotatably mounted around the shaft portion 14*b*.

By providing the shaft portion 14*b* on the first notched gear 14 in this way, the adequate fitting length between the rotary shaft 12 and the first notched gear 14 which is subjected to great load during the rotation can be ensured without increasing a width of the first notched gear 14. That is to say, a width of the entire apparatus corresponding to the length of the shaft portion 14*a* can be reduced without reducing the securing strength between the first notched gear 14 and the rotary shaft 12, thereby making the apparatus compact.

Further, since the first notched gear 14, second notched gear 6 and spring 10 can be assembled as a single unit, the assembling ability of the sheet supplying apparatus can be improved.

Figure 15:
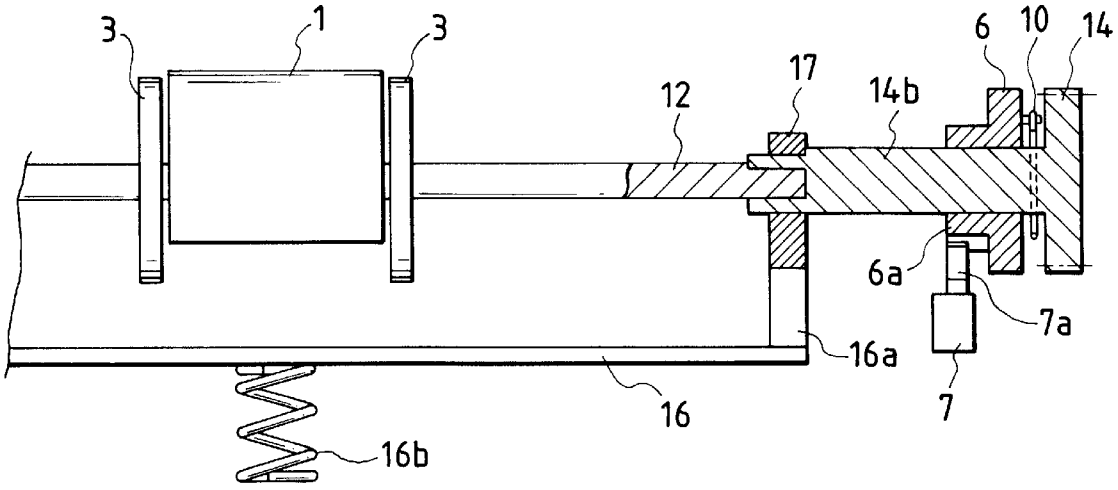
FIG. 15 is a side view, in partial section, of the sheet supplying apparatus of FIG. 14.
Figure 14:
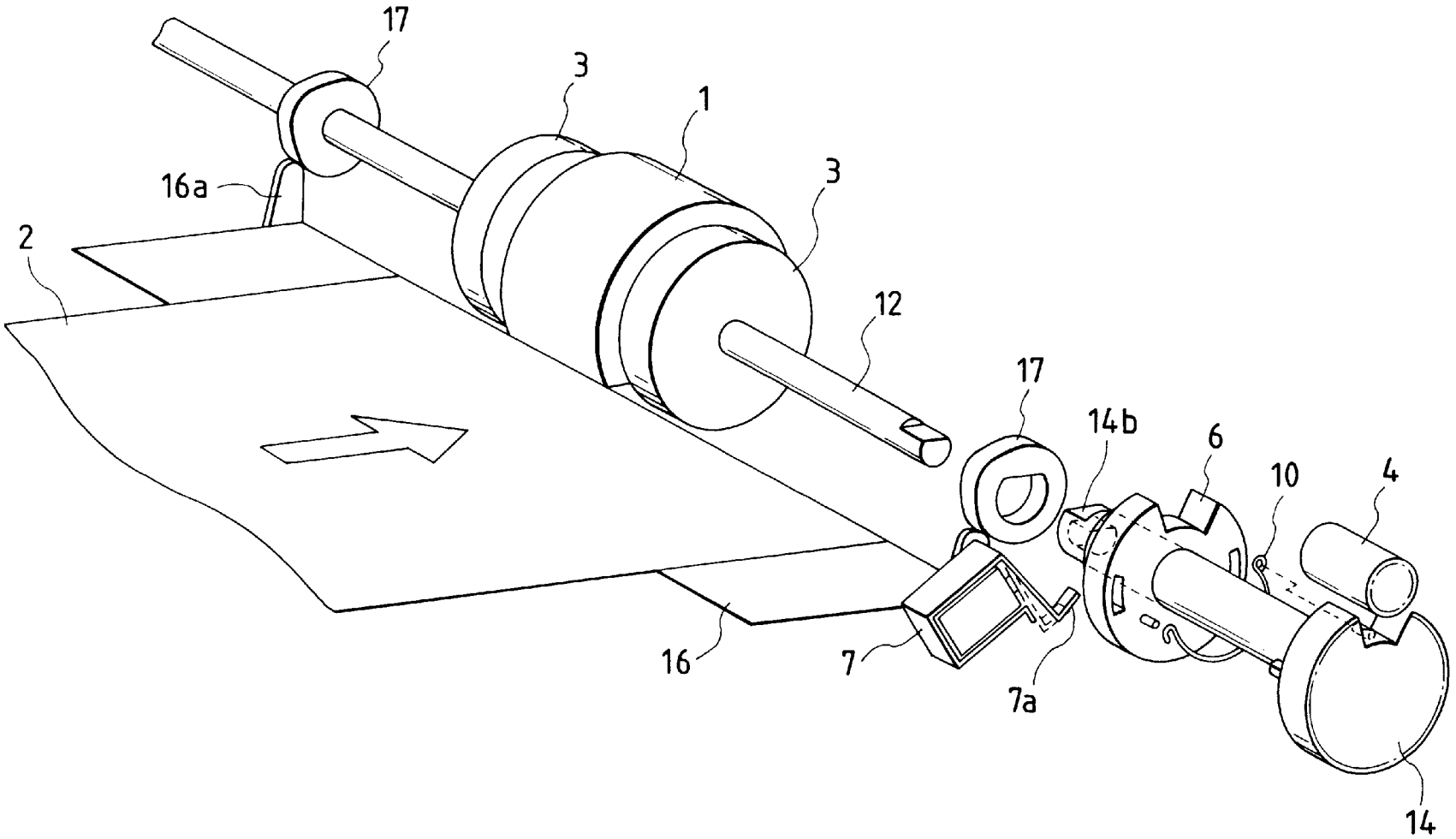
FIG. 14 is an exploded perspective view of a sheet supplying apparatus according to a further embodiment of the present invention.

In the apparatus shown in FIGS. 12 and 13, while the cams 17 were secured to the rotary shaft 12, in a sheet supplying apparatus shown in FIGS. 14 and 15, a shaft portion 14*a* of a first notched gear 14 is extended up to one of the cams 17, and such a cam 17 is fixedly supported by the shaft portion 14*a*.

By directly fixing the cam 17 to the first notched gear 14, positional accuracy in a phase relation between the first notched gear 14 and the cam 17 can be improved.

According to the drive controlling apparatus of the present invention, during the operation of the sheet supply roller returning to its initial position after the sheet supplying operation is completed, when the first notched gear 14 is disengaged from the drive gear 4, as shown in FIG. 2B, it is necessary that the recesses 17*a* of the cams 17 are about to be engaged by the projections 16*a* of the intermediate plate 16, and, it is necessary that the first notched gear 14 is returned to the condition shown in FIG. 2A in which the recesses 17*a* of the cams 17 are completely engaged by the projections 16*a*. Accordingly, when the positional accuracy in the phase relation between the first notched gear 14 and the cam 17 is improved, the operating accuracy of the entire apparatus is also improved.

Figure 16:
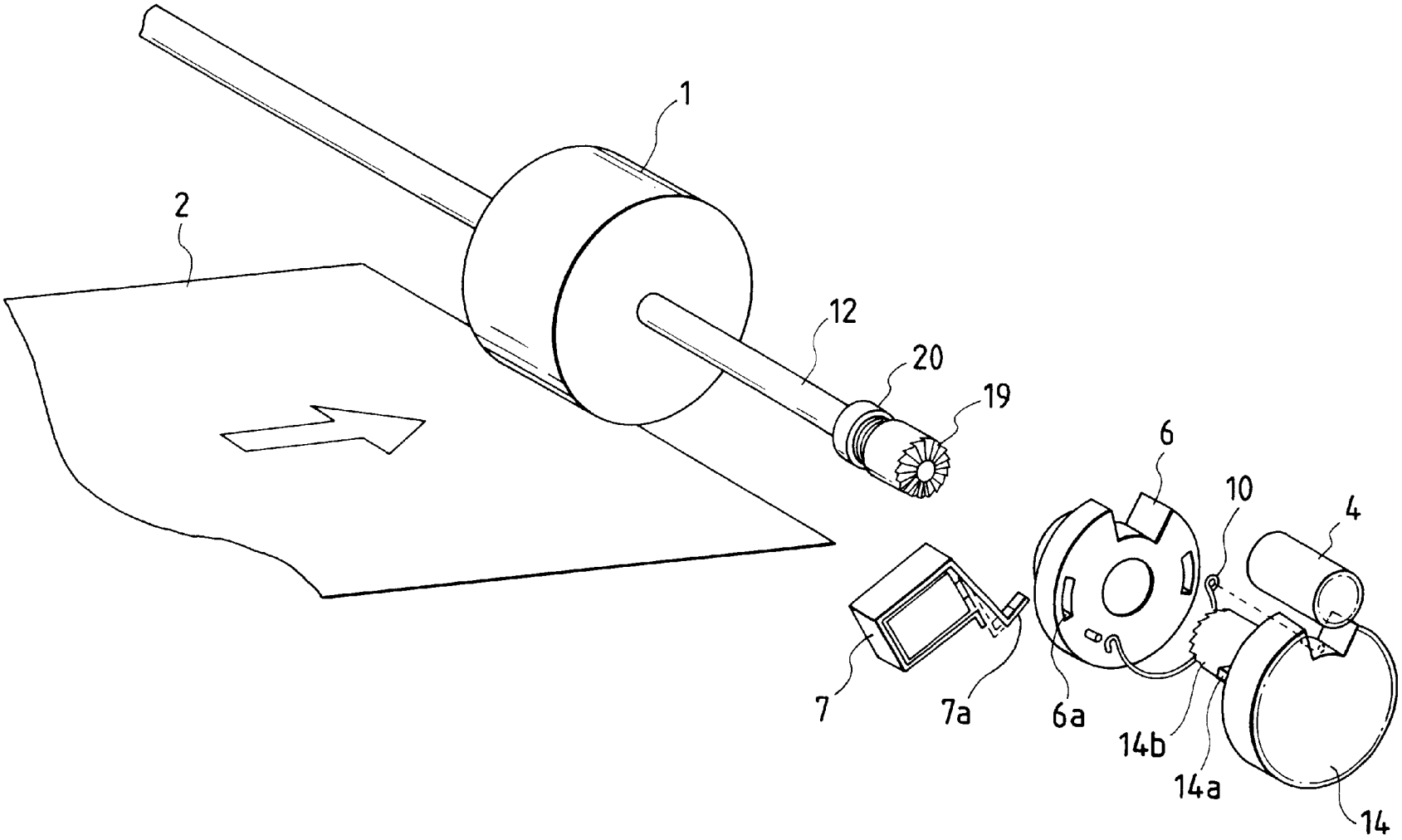
FIG. 16 is an exploded perspective view of a sheet supplying apparatus according to a further embodiment of the present invention.

In a sheet supplying apparatus shown in FIG. 16, a drive controlling apparatus therefor is similar to that shown in FIGS. 12 and 13. However, in FIGS. 12 and 13, the semi-circular roller is used as the sheet supply roller; whereas, in FIG. 16, a cylindrical sheet supply roller and a one-way clutch are used (as is in FIG. 10). As a result, cams and rollers can be omitted, thereby making the entire apparatus simpler.

Figure 17:
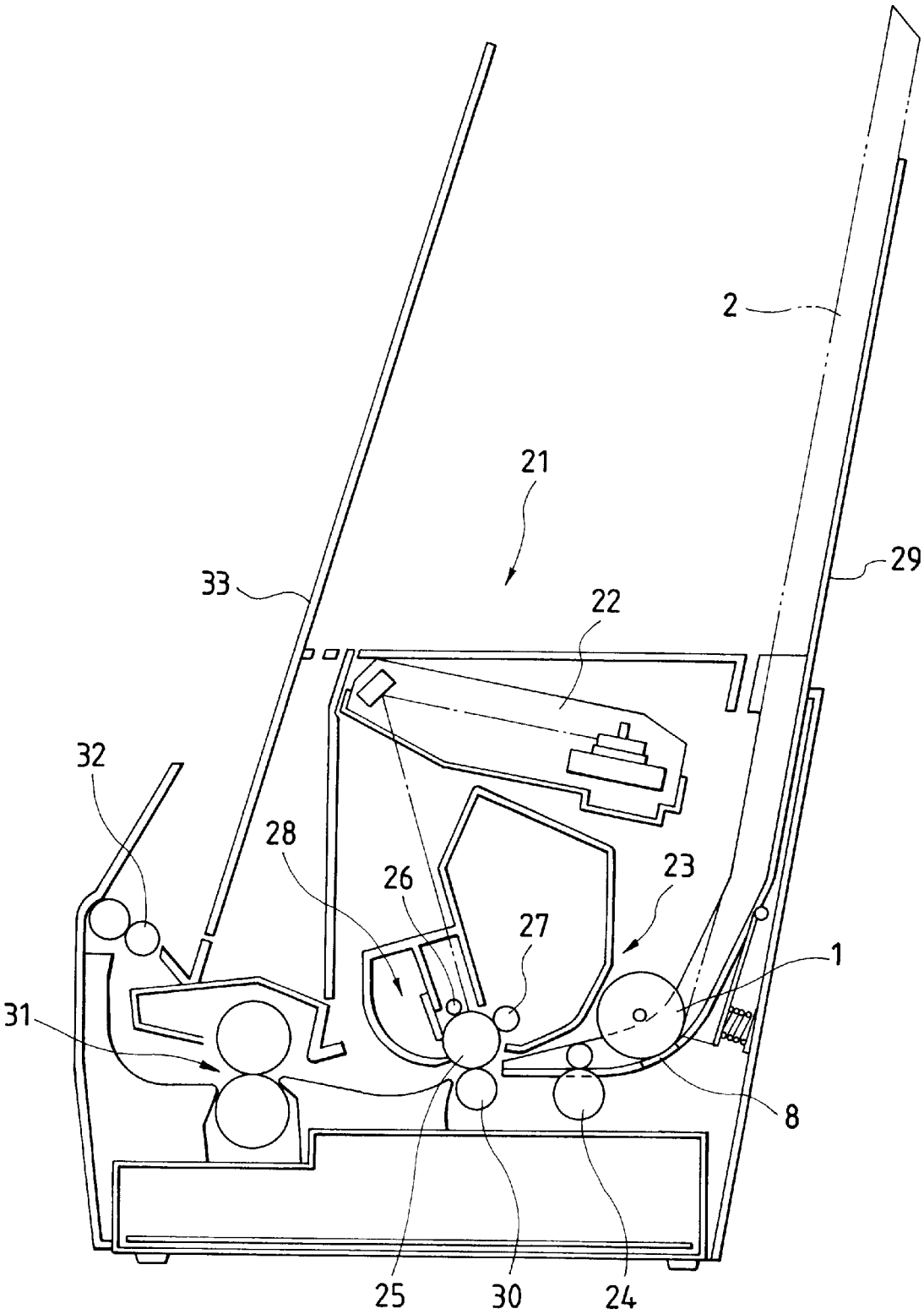
FIG. 17 is a schematic sectional view of an image forming apparatus having a sheet supplying apparatus according to the present invention.
Figure 18:
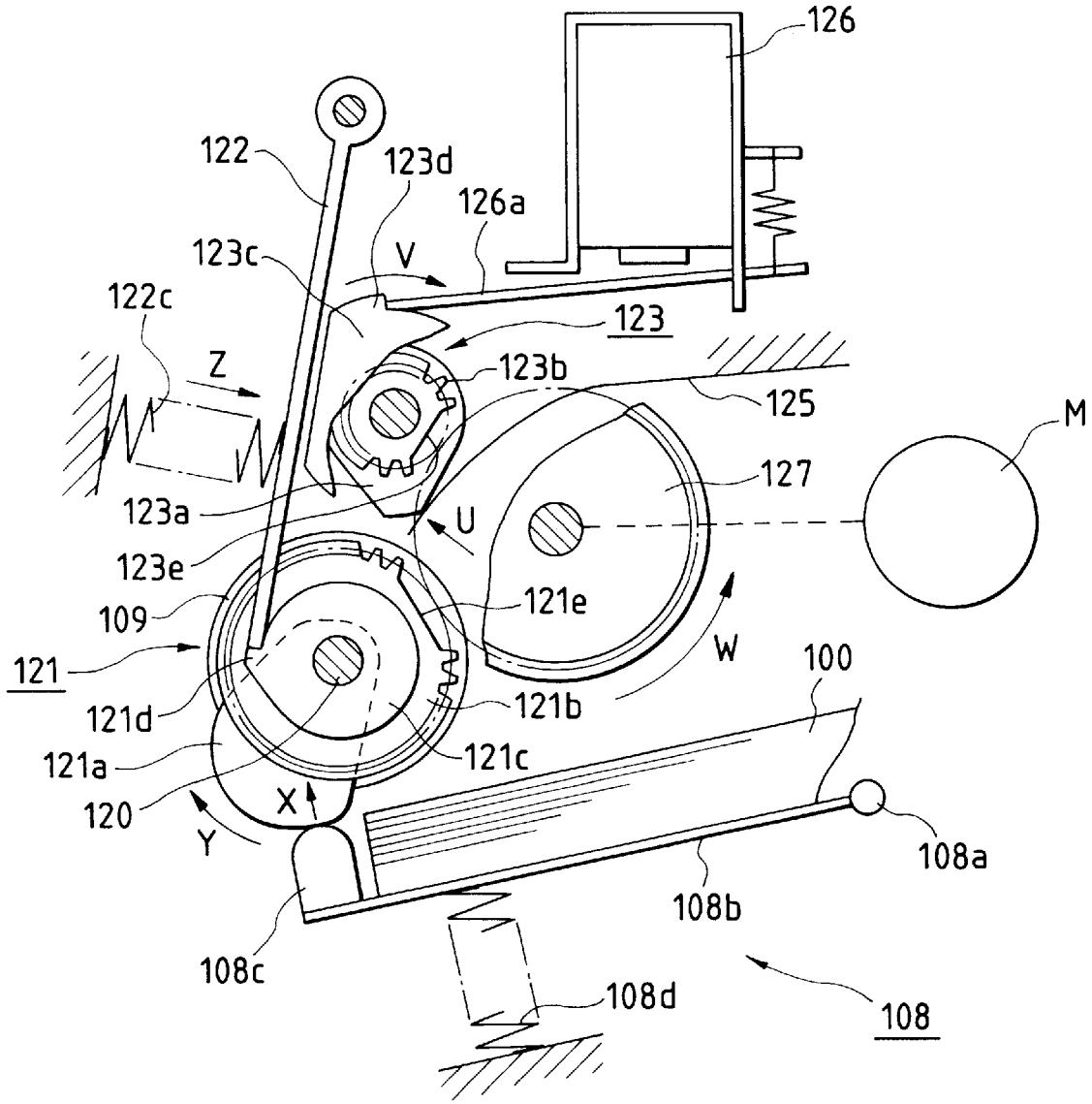
FIG. 18 is a schematic sectional view of a conventional drive controlling apparatus.
Figure 19:
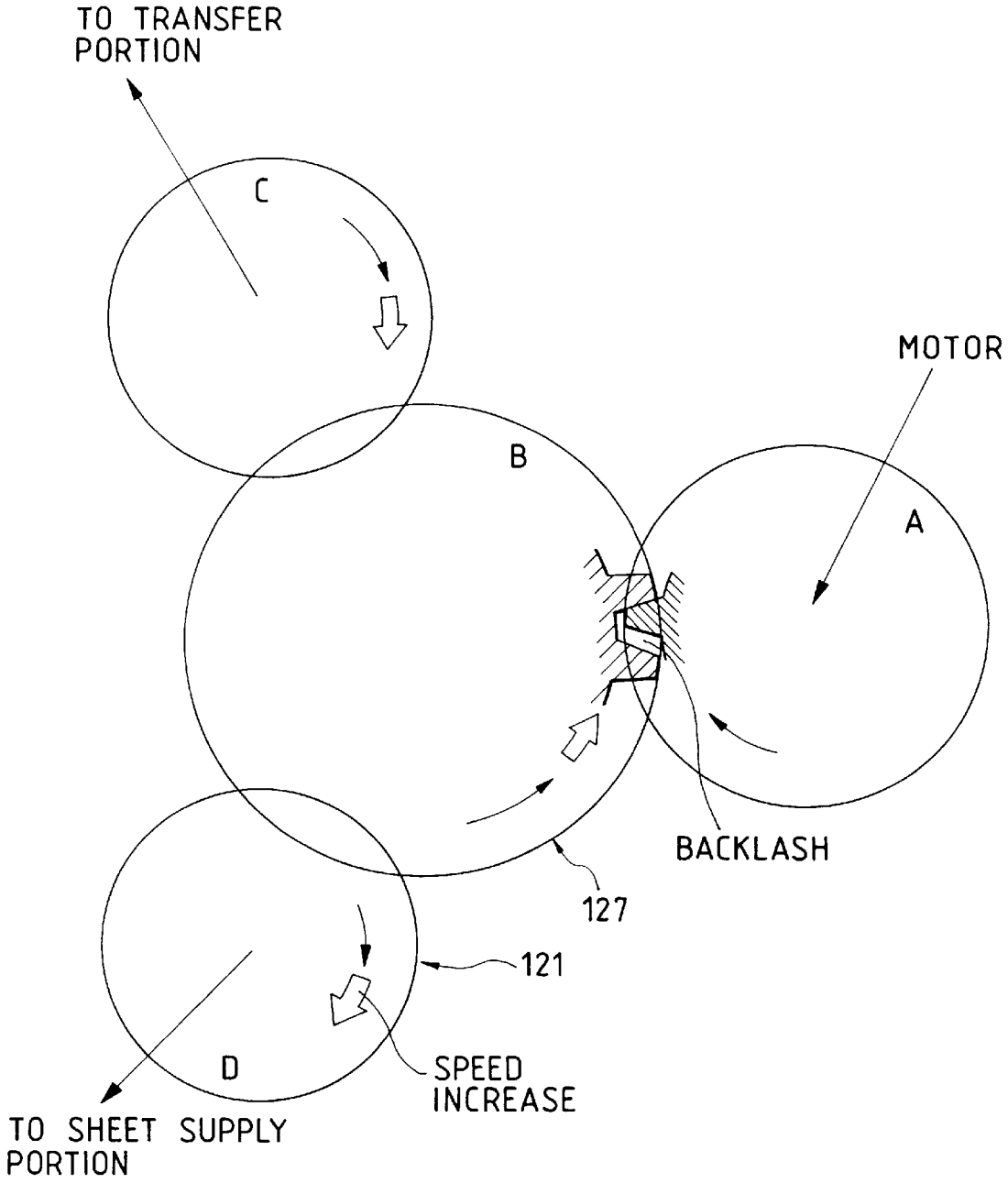
FIG. 19 is an enlarged view of a drive system of the conventional drive controlling apparatus.

FIG. 17 schematically shows an image forming apparatus to which the sheet supplying apparatus having the drive controlling apparatus can be applied.

The image forming apparatus 21 comprises an optical system 22 for emitting laser light in response to image information, an image forming portion 23 including a photosensitive drum (image bearing member) 25, a first charger (corona discharger) 26, a developing device 27 and a cleaner 28, and a sheet convey portion for supplying, conveying and discharging a sheet.

In the image forming portion 23, a surface of the rotating photosensitive drum 25 having a photosensitive layer is uniformly charged by applying voltage to the first charger 26, and a latent image is formed on the photosensitive drum 25 by illuminating the laser light emitted from the optical system 22 in response to the image information through an exposure portion. Then, the latent image is developed by the developing device 27 as a toner image.

On the other hand, in synchronous with the formation of the toner image, a sheet 2 on a tray 29 is supplied by a sheet supply roller 1 forming a part of the sheet supplying apparatus driven by the drive controlling apparatus and is conveyed to the image forming portion 23 by a pair of convey rollers 24 and the like. Then, the toner image is transferred onto the sheet by applying voltage having polarity opposite to that of the toner image to a transfer roller 30. In the image forming portion 23, residual toner remaining on the photosensitive drum 25 is removed by the cleaner 28 for preparation for next image formation.

The sheet to which the toner image was transferred is sent to a fixing roller 31 including a heater therein, where the toner image is fixed to the sheet. Thereafter, the sheet is discharged onto a tray 33 by a pair of discharge rollers 32.

In the above-mentioned embodiments, while an example that each of the notched gears has the single non-toothed portion was explained, two or more non-toothed portions may be provided on each notched gear. Further, while an example that the drive controlling apparatus is used with the sheet supplying apparatus was explained, the present invention is not limited to such an example, the drive controlling apparatus can be used in synchronous with any functioning means for generating rotation of predetermined angle at a predetermined timing.

What is claimed is:

1. A sheet supplying apparatus comprising:

lift/lower sheet supporting means for supporting sheets;

sheet supply means for feeding out the sheets supported by said sheet supporting means, biasing means for biasing said sheet supporting means toward said sheet supply means, thereby the sheets supported by said sheet supporting means are biased against said sheet supply means and the sheets are fed out by an operation of said sheet supply means;

separating means operated by a driving force for separating the sheets supported by said sheet supporting means from said sheet supply means in opposition to a biasing force of said biasing means, drive controlling means for transmitting the driving force from a drive source to said separating means, said drive controlling means having:

drive means for transmitting the driving force from said drive source;

driven means connected to said drive means for transmitting the driving force from said drive means to said separating means; and play setting means provided between said drive means and said driven means for providing a play so as not to transmit said biasing force of said biasing means to said drive means via said separating means and said driven means when an operation of the separation means is released.

2. A sheet supplying apparatus according to claim 1, wherein said drive means comprises a gear to which the driving force is transmitted from said drive source, said driven means comprises a shaft connected to said separating means and also connected to an axis of said gear, and said play setting means comprises a connection means for interconnecting said gear and said shaft for relative displacement within a predetermined angular range in a rotational direction at a connection area between said gear and said shaft.

3. A sheet supplying apparatus according to claim 2, wherein said connection means comprises a key-way formed in said gear and a key formed on said shaft, and said key is received in said key-way for rotational movement within a predetermined angular range in the rotational direction.

4. A sheet supplying apparatus according to claim 3, wherein the predetermined angular range is selected to a range in which, when said sheet supporting means is shifted toward said sheet supply means by said biasing means after the separating operation of said separating means is released, the biasing force of said biasing means acting on said separating means is decreased.

5. A sheet supplying apparatus according to claim 4, wherein said separating means comprises a cam secured to said shaft, and further wherein said sheet supporting means is separated from said sheet supply means by lowering said sheet supporting means by said cam.

6. A sheet supplying apparatus according to claim 2, wherein said gear is a notched gear having a non-toothed portion, and further comprising a regulating means for stopping rotation of said notched gear when said non-toothed portion is opposed to a drive gear receiving the driving force from said drive source, wherein the transmission of the driving force is interrupted by said regulating means.

7. A sheet supplying apparatus according to claim 6, further comprising a gear biasing means for temporarily rotating said notched gear to engage it with said drive gear when said regulating means is released.

8. A sheet supplying apparatus including a lift/lower sheet supporting means for supporting a sheet, a sheet supply means for feeding out the sheet supported by said sheet supporting means, a biasing means for biasing said sheet supporting means toward said sheet supply means, and a separating means for separating said sheet supporting means from said sheet supply means in opposition to a biasing force of said biasing means, wherein the sheet biased against said sheet supply means by said biasing means is fed out by said sheet supply means, a drive controlling means for transmitting a driving force for operating said separating means from a drive source, comprising:

a drive gear connected to said drive source;

a rotary shaft connected to said separating means;

a first notched gear secured to said rotary shaft and engageable with said drive gear;

a second notched gear rotatably supported on said rotary shaft and engageable with said drive gear;

a first regulating means for stopping said first notched gear in a condition that a non-toothed portion of said first notched gear is opposed to said drive gear;

a second regulating means for stopping said second notched gear in a condition that a non-toothed portion of said second notched gear is opposed to said drive gear;

a gear biasing means for rotating said second notched gear to engage it with said drive gear when said regulation of said second regulating means is released; and a cooperating means for releasing regulation of said first regulating means as said second notched gear is rotated while engaging with said drive gear, thereby rotating said first notched gear to engage it with said drive gear.

9. A sheet supplying apparatus according to claim 8, wherein said separating means comprises a cam separating said sheet supporting means from said sheet supply means in opposition to a biasing means of said biasing means by rotation of said cam.

10. A sheet supplying apparatus according to claim 9, wherein said first regulating means comprises a recess provided on one of said cam and said sheet supporting means, and a projection provided on the other of said cam and said sheet supporting means, and further wherein, by engagement between said recess and said projection, said rotary shaft is stopped to regulate said first notched gear.

11. A sheet supplying apparatus according to claim 8, wherein said second regulating means comprises a locking portion provided on said second notched gear, and a solenoid having a locking pawl capable of engaging and disengaging with respect to said locking portion and adapted to shift said locking pawl to an engaging position and a disengaging position in response to energization and disenergization of said solenoid.

12. A sheet supplying apparatus according to claim 8, wherein said gear biasing means comprises a spring for rotating said second notched gear to engage said second notched gear with said drive gear when the regulation of said second regulating means is released.

13. A sheet supplying apparatus according to claim 8, wherein said cooperating means comprises a key provided on said rotary shaft and a key-way provided in said second notched gear, and said key-way is dimensioned so that said key can be moved within said key-way to permit the rotation of said second notched gear relative to said rotary shaft within a predetermined range.

14. A sheet supplying apparatus according to claim 8, wherein said cooperating means is set so that the rotation of said first notched gear is started at a predetermined delay timing after the rotation of said second notched gear is started upon releasing of the regulation of said second regulating means, and said delay timing is set so that said second notched gear is not rotated until a force transmitting from said biasing means to said separating means is decreased, when the regulation of said first regulating means is released by the rotation of said second notched gear.

15. A sheet supplying apparatus according to claim 8, wherein said first and second notched gears are disposed side by side on said rotary shaft, and a relative position between said first and second notched gears is regulated by said cooperating means in such a manner that, when the rotation of said first notched gear is started, said second notched gear is engaged by said drive gear with the same phase as said first notched gear.

16. A sheet supplying apparatus according to claim 8, wherein said sheet supply means comprises a roller provided on said rotary shaft and rotated together with said rotary shaft to feed out the sheet.

17. A sheet supplying apparatus according to claim 16, wherein said roller is a semi-circular roller, and further comprising a roller disposed in the vicinity of said cut-out roller and rotatably provided on said rotary shaft.

18. A sheet supplying apparatus according to claim 16, wherein said roller is a cylindrical roller, and further comprising a one-way clutch disposed between said cylindrical roller and said rotary shaft so that, even when said rotary shaft is stopped by said one-way clutch during the sheet is being supplied, said cylindrical roller is rotated by the sheet being supplied.

19. A sheet supplying apparatus according to claim 8, wherein said sheet supporting means comprises a pivotable intermediate plate for supporting the sheet, and said biasing means comprises a spring for biasing said intermediate plate toward said sheet supply means.

20. An image forming apparatus comprising:

lift/lower sheet supporting means for supporting sheets;

sheet supply means for feeding out the sheets supported by said sheet supporting means, biasing means for biasing said sheet supporting means toward said sheet supply means, thereby the sheets supported by said sheet supporting means are biased against said sheet supply means and the sheets are fed out by an operation of said sheet supply means;

separating means operated by a driving force for separating the sheets supported by said sheet supporting means from said sheet supply means in opposition to a biasing force of said biasing means, image forming means for forming an image on the sheet fed by said sheet supply means, and a drive controlling apparatus for transmitting the driving force from a drive source to said separating means, said drive controlling apparatus having drive means for transmitting the driving force from said drive source;

driven means connected to said drive means for transmitting the driving force from said drive means to said separating means; and play setting means provided between said drive means and driven means for providing a play so as not to transmit said biasing force of said biasing means to said drive means via said separating means and said driven means when an operation of the separation means is released.

21. An image forming apparatus including a lift/lower sheet supporting means for supporting a sheet, a sheet supply means for feeding out the sheet supported by said sheet supporting means, a biasing means for biasing said sheet supporting means toward said sheet supply means, a separating means for separating said sheet supporting means from said sheet supply means in opposition to a biasing force of said biasing means, and an image forming means for forming an image on the sheet fed out by said sheet supply means, and wherein the sheet biased against said sheet supply means by said biasing means is fed out by said sheet supply means and the image is formed on said sheet by said image forming means, a drive controlling apparatus for transmitting a driving force for operating said separating means from a drive source, comprising:

a drive gear connected to said drive source;

a rotary shaft connected to said separating means;

a first notched gear secured to said rotary shaft and engageable with said drive gear;

a second notched gear rotatably supported on said rotary shaft and engageable with said drive gear;

a first regulating means for stopping said first notched gear in a condition that a non-toothed portion of said first notched gear is opposed to said drive gear;

a second regulating means for stopping said second notched gear in a condition that a non-toothed portion of said second notched gear is opposed to said drive gear;

a gear biasing means for rotating said second notched gear to engage it with said drive gear when said regulation of said second regulating means is released; and a cooperating means for releasing regulation of said first regulating means as said second notched gear is rotated while engaging with said drive gear, thereby rotating said first notched gear to engage it with said drive gear.

* * * * *

UNITED STATES PATENT AND TRADEMARK OFFICE

CERTIFICATE OF CORRECTION

PATENT NO. : 6,070,867
DATED : June 6, 2000
INVENTOR(S) : Yuzuru Tsurumi, et al.

It is certified that error appears in the above-identified patent and that said Letters Patent is hereby corrected as shown below:

Column 1:
Line 36, "the sheet supply roller" (1st occurrence) should be deleted.

Column 2:
Line 63, "of" should be deleted.

Column 6:
Line 16, "gears" should read --gear--.

Column 7:
Line 55, "so at" should be deleted.

Column 8:
Line 54, "an" should read --a--.

Column 9:
Line 58, "may" should read --may be--.

UNITED STATES PATENT AND TRADEMARK OFFICE

CERTIFICATE OF CORRECTION

PATENT NO. : 6,070,867
DATED : June 6, 2000
INVENTOR(S) : Yuzuru Tsurumi, et al.

It is certified that error appears in the above-identified patent and that said Letters Patent is hereby corrected as shown below:

Column 11:
Line 40, "for" should read --for the--;
Line 46, "has" should read --having--;
Line 53, "of" should read --of a--.

Signed and Sealed this

Twenty-sixth Day of June, 2001

Nicholas P. Godici

*Attest:*

*Attesting Officer*

NICHOLAS P. GODICI
*Acting Director of the United States Patent and Trademark Office*